US005695672A

United States Patent [19]

Kim

[11] Patent Number: 5,695,672

[45] Date of Patent: Dec. 9, 1997

[54] MICROWAVE OVEN HAVING VERTICALLY ADJUSTABLE TURNTABLE

[75] Inventor: Tae-Bong Kim, Suwon, Rep. of Korea

[73] Assignee: Samsung Electronics Co., Ltd., Suwon, Rep. of Korea

[21] Appl. No.: 680,817

[22] Filed: Jul. 16, 1996

[30] Foreign Application Priority Data

Jul. 19, 1995 [KR] Rep. of Korea ..... 95-21231

[51] Int. Cl.[6] ..... H05B 6/68; H05B 6/78

[52] U.S. Cl. ..... 219/709; 219/704; 219/753; 219/763

[58] Field of Search ..... 219/709, 763, 219/752, 753, 702, 704, 705, 518; 99/325, 451, DIG. 14

[56] References Cited

U.S. PATENT DOCUMENTS

| | | | |
|---|---|---|---|
| 4,196,332 | 4/1980 | MacKay et al. | 219/709 |
| 4,714,811 | 12/1987 | Gerling et al. | 219/702 |
| 4,757,173 | 7/1988 | Park | 219/753 |
| 4,833,304 | 5/1989 | Ueda | 219/518 |
| 5,369,252 | 11/1994 | Kondo | 219/704 |
| 5,512,736 | 4/1996 | Kang et al. | 219/704 |

*Primary Examiner*—Philip H. Leung

*Attorney, Agent, or Firm*—Burns, Doane, Swecker & Mathis, L.L.P.

[57] ABSTRACT

A microwave oven has a cooking chamber in which a vertically movable turntable is disposed. During the onset of a cooking operation, a control mechanism automatically raises the turntable in step-by-step fashion, and the amount of high frequency waves reflected from the cooking chamber is detected at each vertical position of the turntable. Then, the vertical position of the turntable at which the detected amount of reflective frequency was the lowest is determined, and the turntable is set at that position to continue the cooking operation. If the detected amount of reflective frequency changes, a new vertical position of the turntable at which the amount of reflective frequency is lowest, is re-determined, and the turntable is set at that new position.

5 Claims, 3 Drawing Sheets

MICROWAVE OVEN HAVING VERTICALLY ADJUSTABLE TURNTABLE

BACKGROUND OF THE INVENTION

1. Field of the Invention

The present invention relates to a microwave oven and a control method therefor so that the cooking efficiency can be efficiently increased.

2. Description of the Prior Art

A conventional microwave oven includes high frequency generating means for generating high frequency, a waveguide for transmitting the high frequency, and a cooking chamber for cooking food by way of the high frequency output from the waveguide.

However, there is a problem in the conventional microwave oven thus constructed, in that an impedance on a transmission route of the high frequency is fixed so that the impedance cannot be matched according to quantity and kind of the food and heating condition, thereby decreasing a cooking efficiency due to increased amount of reflective waves reflected from wall surfaces of the cooking chamber and the like.

SUMMARY OF THE INVENTION

Accordingly, the present invention is disclosed to solve the aforementioned problem and it is an object of the present invention to provide a microwave oven for increasing a cooking efficiency and a control method thereof.

In accordance with one aspect of the present invention, there is provided a microwave oven for receiving a cooking command to thereby cook the food, the microwave oven comprising:

- high frequency detecting means for detecting changes in amount of the high frequency reflected from a cooking chamber;
- control means for storing per step the amount of the reflective waves detected by the high frequency detecting means to compare same and to generate a control command; and
- position changing means for vertically moving a rotary dish according to the control command output from the control means, so that a cooking operation is performed at a position where the amount of the high frequency reflected from the cooking chamber is minimized, thereby improving the cooking efficiency.

In accordance with another aspect of the present invention, there is provided a method of increasing a cooking efficiency of a microwave oven for cooking food by receiving a cooking command, the method comprising the steps of:

- sequentially raising a rotary dish from a lowest level (0 step) to a highest level (N step) when the cooking command is input and sensing amount of reflected high frequency generated in the cooking chamber to thereby store same step by step (S1);
- discriminating whether the rotary dish has reached the highest level (N step) (S2);
- comparing the amount of reflected waves per step once the rotary dish is raised to the highest level (N step) to move the rotary dish to a position where the amount of the reflected waves is minimized and to thereby fix same at the position (S3);
- comparing the time of the cooking operation being progressed at the position with the cooking time established in accordance with the cooking command (S4); and

- moving a position of the rotary dish to the lowest level (0 step) when the time of the cooking operation being progressed has passed the time of the established cooking time, to thereby fix same at the lowest level.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF A PREFERRED EMBODIMENT OF THE INVENTION

The embodiment of the present invention will now be described in detail with reference to the accompanying drawings.

Figure 1:
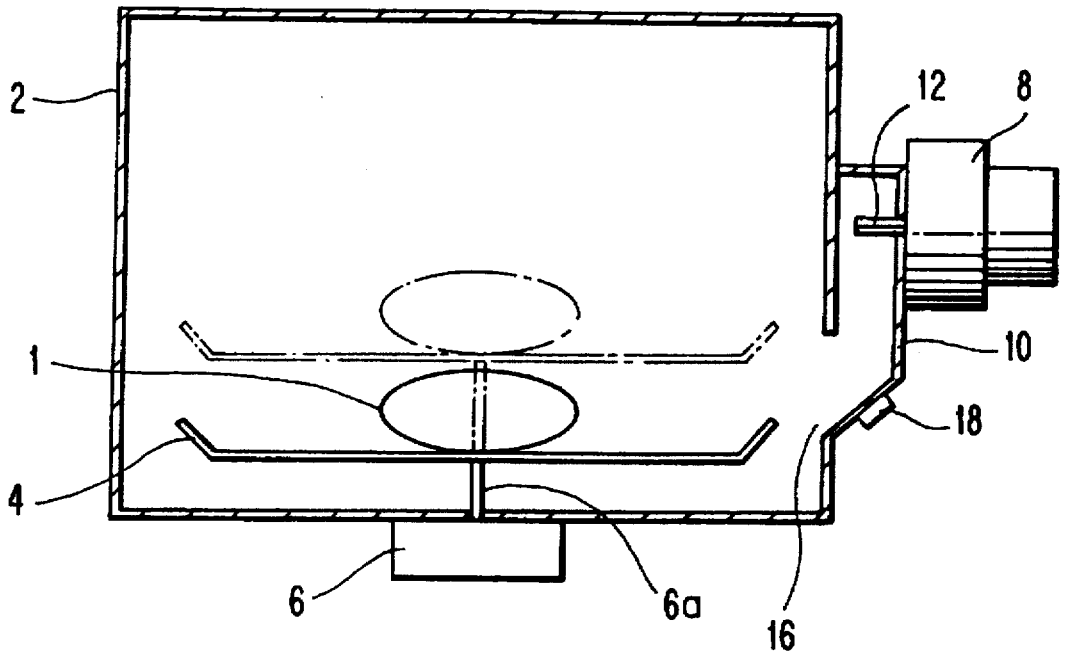
FIG. 1 is a sectional view of a microwave oven according to an embodiment of the present invention.

Referring to FIG. 1, a cooking chamber 2 for cooking the food is provided with a rotary dish (turntable) 4 for rotating the food thereon.

The rotary dish 4 is fixed to an axis 6*a* of position changing shaft means 6 for changing a vertical position of the rotary dish, so that the amount of high frequency reflected from the cooking chamber 2 can be minimized according to the amount of the high frequency input to control means (described later) from high frequency detecting means 18.

The cooking chamber 2 is provided at one side thereof with a magnetron 8 for generating high frequency according to a control signal output from the control means.

The magnetron 8 is provided with an antenna 12 for generating high frequency to a waveguide 10.

A hole 16 is formed between the waveguide 10 and the cooking chamber 2 to allow the high frequency waves output from the waveguide 10 to pass therethrough.

The waveguide 10 is provided with the high frequency detecting means 18 for detecting the amount of high frequency reflected from the cooking chamber 2.

Figure 2:
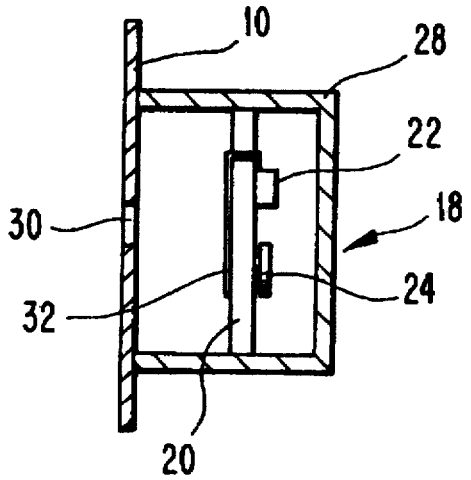
FIG. 2 is an enlarged view of a high frequency detecting means in the microwave oven illustrated in FIG. 1.
Figure 3:
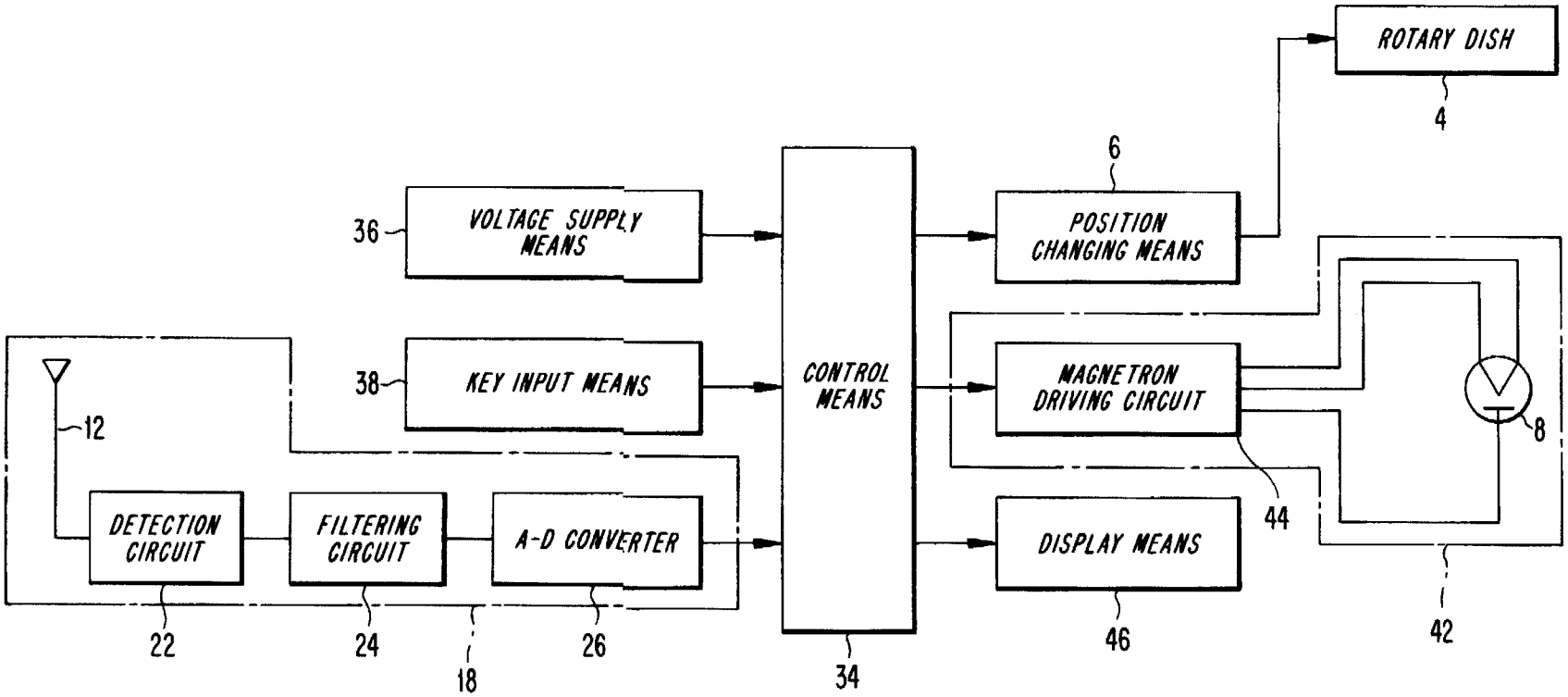
FIG. 3 is a block diagram of a control circuit in the microwave oven according to FIG. 1.

The high frequency detecting means 18, as illustrated in FIGS. 2 and 3, includes an antenna 20 for receiving the high frequency reflected from the cooking chamber 2, a detection circuit 22 for rectifying the high frequency output from the antenna 20 to thereby output amount of reflective waves reflected from the cooking chamber 2, a filtering circuit 24 for removing noise contained in the reflective waves output from the detecting circuit 22, and a Analog-to- Digital (A-D) converter 26 for converting the amount of the reflective waves in analog signal output from the filtering circuit 24 to amount of reflective waves in digital signal to thereby generate the amount of the reflective waves to the control means.

The antenna 20, the detection circuit 22 and the filtering circuit 24 are disposed in a second housing 28 in order to receive the high frequency reflected from the cooking chamber 2.

A second hole 30 is formed between the second housing 28 and the waveguide 10 in order to pass the high frequency reflected from the cooking chamber 2 into the second housing 28.

The detection circuit 22 is fixed to a lead wire 32 in order to receive the high frequency from the antenna 20.

As illustrated in FIG. 3, the control means 34 is a microcomputer which serves to store per step the amount of reflective waves sensed by the high frequency detecting means 14, perform a comparison step and generate a control command.

Voltage supply means 36 is connected to the control means 34 in order to supply DC voltage of 5V to the control means 34.

Key input means 38 is connected to the control means 34 is order to supply a user's command to the control means Position changing means 6 is connected to the control means 34 in order to vertically move the rotary dish 4 according to the control command from the control means 34.

High frequency generating means 42 includes (i) a magnetron driving circuit 44 for receiving a control signal from the control means 34 to supply a high voltage to the magnetron 8, and (ii) the magnetron 8 for receiving the high voltage from the magnetron driving circuit 44 to thereby generate the high frequency.

Display means 46 is connected to the control means 34 in order to receive a display signal from the control means 34 to thereby display a working condition.

Figure 4:
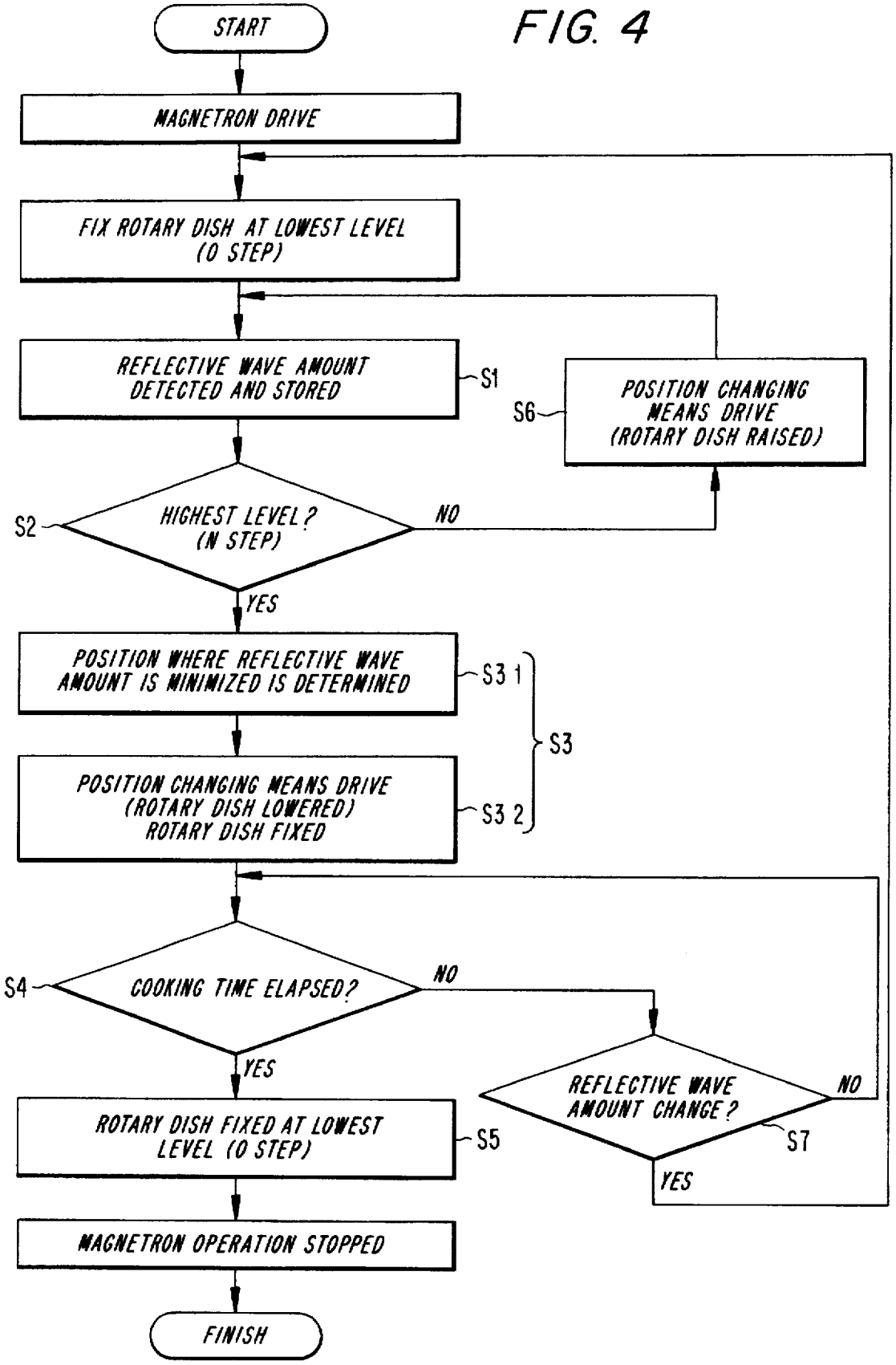
FIG. 4 is a flow chart of a control method for the microwave oven according to FIG. 1.

Now, a control method of the microwave oven according to the embodiment of the present invention will be described with reference to FIG. 4.

First of all, the user opens a door (not described) to put food on the rotary dish 4.

Then, the door is shut and a cooking menu and command of cooking time are manually input to the key input means 38.

The command is output to the control means 34 from the key input means 38, and then, the cooking menu and the cooking time are memorized in the control means 34.

The user then pushes a cooking start button equipped at the key input means 38, and a cooking start command is output from the key input means 38 to the control means 34.

Next, a control signal is output from the control means 34 to the magnetron driving circuit 44, and successively, a DC voltage of 4.000v is output from the magnetron driving circuit 44 to the magnetron 8.

High frequency waves are generated from the antenna 12 at the magnetron 8, which passes through the waveguide 10 and the hole 16 to thereafter be scanned into the cooking chamber 2.

The food on the rotary dish 4 begins to be then cooked.

At the same time, a control signal is output from the control means to the position change means 6, which serves to drive the position changing means 6 to thereby lower the rotary dish 4.

Thus, the rotary dish 4, as indicated in a solid line in FIG. 1, comes to rest at the lowest level (0 step) previously established at the control means 34.

At step S1, high frequency reflected from the cooking chamber 2 passes through the hole 16 into the waveguide 10.

Next, the reflective waves pass through the hole 30 in the high frequency detecting means 18 to thereafter be received by the antenna 12.

Then, the high frequency waves are output to the detection circuit 22 from the antenna 12 and are rectified thereby.

The amount of rectified reflective waves are output from the detection circuit 22 to the filtering circuit 24.

Successively, the noise contained in the amount of the reflective waves from the filtering circuit 24 and the amount of the reflective waves are supplied from the filtering circuit 24 to the A-D converter 26, from which the amount of the reflective waves are output to the control means 34. As this occurs, the rotary dish 4 is gradually raised step-by-step toward a highest level, and the amount of reflective waves occurring at each step is detected and stored in a memory of the control means 34.

At step 2, the control means 34 discriminates whether the rotary dish 4 is at the highest level (N step) previously established therein by way of example, N is 10 at this step.

As a result of the discrimination, as illustrated in a dotted line in FIG. 1, if it is discriminated that the rotary dish 4 is at the highest level (N step) (in case of YES), flow proceeds to step S31.

At step S31, the control means 34 determines a position of the rotary dish where the amount of the high frequency reflected from the cooking chamber 2 is the lowest.

Next, at step S32, a control signal is generated from the control means 34 to the position changing means 6, where the position changing means 6 is activated to lower the rotary dish 4 to the position where the amount of reflected high frequency was detected to be the lowest.

Next, at step S4, the control means 34 discriminates whether cooking time has elapsed.

As a result of the discrimination, if the cooking time has elapsed, flow advances to step S5.

At step S5, a control signal is output from the control means 34 to the position changing means 6.

Then, the position changing means 6 is activated to lower the rotary dish 4.

Successively, the rotary dish 4 is fixed at the lowest level (o step) previously established in the memory of the control means 34.

Next, a control signal is output from the control means 34 to the magnetron driving circuit 44 which stops the supply of voltage to the magnetron 8.

Then, the magnetron 8 is stopped of its operation to thereby complete the cooking operation.

Meanwhile, at step S2, if it is discriminated that the rotary dish 4 is not at the highest level (N step) previously established in the memory of the control means 34, flow proceeds to step S6.

At step S6, a control signal is output from the control means 34 to the position changing means 6, which is then activated to cause the rotary dish 4 to be raised as much as one step previously established in the memory of the control means 34.

Next, flow advances to step S1, where the amount of high frequency reflected from the cooking chamber 2 is detected per step and is stored.

Meanwhile, at step S4, if it is discriminated that the cooking time has not elapsed, in other words, the food is still being cooked, flow proceeds to step S7 to discriminate whether the amount of the reflective waves has changed.

At step S7, it is discriminated whether the amount of the high frequency reflected from the cooking chamber has changed.

As a result of the discrimination, if it is discriminated that the amount of the high frequency reflected from the cooking chamber 2 has changed, the rotary dish is lowered to the lowest level (0 step).

Then, as mentioned above step S1 is repeated wherein, the rotary dish 4 is changed in vertical position from the lowest level to the highest level and a height where the amount of the reflected high frequency is smallest is determined.

Meanwhile, at step S7, if it is discriminated that the amount of the high frequency reflected from the cooking chamber 2 has not changed, flow proceeds to step S4, continuously fixing the rotary dish 4 at the position where the amount of the high frequency reflected from the cooking chamber 2 is minimized and discriminating whether the cooking time has elapsed.

As apparent from the foregoing, there is an advantage in the control method of microwave oven according to the embodiment of the present invention, in that a rotary dish can be adjusted in height thereof according to quantity, kind of the food and heating condition during the cooking process, to thereby change the impedance of the transmission route of the high frequency, so that amount of the reflective waves generated from the microwave oven can be minimized to improve a cooking efficiency.

What is claimed is:

1. In a microwave oven comprising a cooking chamber, a magnetron for supplying high frequency to the cooking chamber, a vertically movable, rotary dish disposed in the cooking chamber, and a control mechanism for determining a vertical position of the rotary dish during a cooking operation; the control mechanism comprising a detector for sensing the amounts of high frequency reflected from the cooking chamber when the rotary dish is disposed at various vertical positions; and means for moving the rotary dish to the one vertical position at which the amount of detected reflective high frequency is lowest.

2. The microwave oven according to claim 1, wherein the detector comprises:

an antenna for receiving high frequency reflected from the cooking chamber and outputting that high frequency;

a detection circuit for rectifying the high frequency output from the antenna, and outputting that rectified high frequency;

a filtering circuit for removing noise contained in the rectified high frequency; and an Analog-to-Digital converter for converting the amount of rectified high frequency output in analog signal from the filtering circuit into a digital signal.

3. A method of operating a microwave oven, the oven comprising a cooking chamber, a magnetron for supplying high frequency to the cooking chamber, a controller for setting a cooking period, and a vertically movable, rotary dish disposed in the cooking chamber, the method comprising the steps of:

A) positioning food on the rotary dish;

B) setting a cooking period in the controller;

C) supplying high frequency from the magnetron to the cooking chamber;

D) during step C, gradually moving the rotary dish vertically in a step-by-step manner;

E) during step D, sensing an amount of high frequency reflected from the cooking chamber at each vertical position of the rotary dish;

F) determining the one of the vertical positions at which the amount of reflected high frequency is the smallest;

G) moving the rotary dish to that one position; and

H) moving the rotary dish to a lowest position and deactivating the magnetron, when the cooking period has elapsed.

4. The method according to claim 3, wherein during step D, the rotary dish is gradually moved from the lowest position to a highest position.

5. The method according to claim 3, further including, after step G and before step H, the step of again sensing the amount of detected reflective waves at the one position, and repeating steps D, E, F and G when the amount of detected reflective waves at the one position changes.

* * * * *